US010083807B2

(12) United States Patent
Wu et al.

(10) Patent No.: US 10,083,807 B2
(45) Date of Patent: Sep. 25, 2018

(54) METAL SWITCH FOR INPUT DEVICE

(71) Applicant: Apple Inc., Cupertino, CA (US)

(72) Inventors: Chia-Chi Wu, Taipei (TW); Zheng Gao, Cupertino, CA (US); Ming Gavin Gao, Shanghai (CN); Paul X. Wang, Cupertino, CA (US); Alex J. Lehmann, Cupertino, CA (US); Richard Xu, Cupertino, CA (US); Kenneth M. Silz, Cupertino, CA (US); Chia-Wei Lee, Shanghai (CN)

(73) Assignee: APPLE INC., Cupertino, CA (US)

( * ) Notice: Subject to any disclaimer, the term of this patent is extended or adjusted under 35 U.S.C. 154(b) by 182 days.

(21) Appl. No.: 15/163,580

(22) Filed: May 24, 2016

(65) Prior Publication Data

US 2017/0345589 A1 Nov. 30, 2017

(51) Int. Cl.

*H01H 13/785* (2006.01)
*H01H 13/85* (2006.01)
*H01H 13/52* (2006.01)

(52) U.S. Cl.

CPC ..... *H01H 13/785* (2013.01); *H01H 13/52* (2013.01); *H01H 13/85* (2013.01)

(58) Field of Classification Search

CPC ..... H01H 13/785; H01H 13/52; H01H 13/85
USPC ..... 200/5 A, 520
See application file for complete search history.

(56) References Cited

U.S. PATENT DOCUMENTS

| | | | | |
|---|---|---|---|---|
| 4,029,916 | A * | 6/1977 | Chu | H01H 13/7006 200/275 |
| 4,354,068 | A | 10/1982 | Sobel, III | |
| 4,634,818 | A | 1/1987 | Hayes-Pankhurst et al. | |
| 5,340,955 | A | 8/1994 | Calvillo et al. | |
| 5,389,757 | A | 2/1995 | Souliere | |
| 5,559,311 | A | 9/1996 | Gorbatoff | |
| 5,898,147 | A * | 4/1999 | Domzalski | H01H 13/48 200/1 B |
| 6,118,092 | A | 9/2000 | Hayashi | |
| 6,246,019 | B1 | 6/2001 | Nakamura et al. | |
| 6,344,791 | B1 | 2/2002 | Armstrong | |
| 7,250,581 | B2 | 7/2007 | Asada | |
| 7,301,113 | B2 * | 11/2007 | Nishimura | H01H 13/48 200/406 |
| 7,368,672 | B2 * | 5/2008 | Yanai | H01H 13/48 200/5 A |
| 8,431,852 | B2 | 4/2013 | Maruyama et al. | |
| 9,224,554 | B2 | 12/2015 | Krumpelman | |
| 9,449,769 | B2 | 9/2016 | Leong et al. | |
| 2003/0188960 | A1 * | 10/2003 | Hsu | G06F 1/1613 200/344 |
| 2011/0000775 | A1 * | 1/2011 | Itou | H01H 13/705 200/520 |

(Continued)

*Primary Examiner* — Edwin A. Leon
*Assistant Examiner* — Iman Malakooti
(74) *Attorney, Agent, or Firm* — Dorsey & Whitney LLP

(57) ABSTRACT

A key mechanism is disclosed. The key mechanism comprises a keycap, a dome support structure positioned relative to the keycap and defining an opening, an actuation mechanism coupled to the keycap, and a collapsible dome positioned in the opening of the dome support structure. The actuation mechanism is configured to movably support the keycap relative to the dome support structure. The dome comprises an upstop member configured to limit upward travel of the collapsible dome.

20 Claims, 11 Drawing Sheets

(56) References Cited

U.S. PATENT DOCUMENTS

| | | | | |
|---|---|---|---|---|
| 2012/0182673 | A1 | 7/2012 | Wang et al. | |
| 2012/0292168 | A1* | 11/2012 | Chiba | H01H 3/125 200/344 |

* cited by examiner

METAL SWITCH FOR INPUT DEVICE

FIELD

The described embodiments relate generally to electronic devices, and more particularly to input devices for electronic devices.

BACKGROUND

Many electronic devices include one or more input devices such as keyboards, touchpads, mice, or touchscreens to enable a user to interact with the device. These devices can be integrated into an electronic device or can stand alone as discrete devices that can transmit signals to another device either via wired or wireless connection. For example, a keyboard can be integrated into the housing of a laptop computer or it can exist in its own housing.

The keys of a keyboard may include various mechanical and electrical components to facilitate the mechanical and electrical functions of the keyboard. For example, a key may include mechanical structures to allow the key to move or depress when actuated, as well as electrical components to allow an electrical signal to be produced in response to actuation.

SUMMARY

A key mechanism comprises a keycap, a dome support structure positioned relative to the keycap and defining an opening, an actuation mechanism coupled to the keycap, and a collapsible dome positioned in the opening of the dome support structure. The actuation mechanism is configured to movably support the keycap relative to the dome support structure. The collapsible dome comprises an upstop member configured to limit upward travel of the collapsible dome.

A key mechanism comprises a frame member defining a travel limiting feature, and a switch member coupled to the frame member. The switch member comprises an actuation region and an arm extending from the actuation region. When the key mechanism is in an undepressed state, the arm contacts the travel limiting feature.

A dome for an input mechanism comprises an actuation region, first and second cantilevered biasing arms extending from the actuation region, and a cantilevered upstop arm extending from the actuation region.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

Keyboards use various different mechanisms to provide mechanical and electrical functionality. For example, keys may include springs or domes to bias the keys to an undepressed or unactuated position, and articulating mechanical structures to moveably couple the keys to a base of the keyboard. Keys may also include electrical contacts, terminals, or switches to detect when a key has been depressed or actuated in order to provide a corresponding input signal to an electronic device.

Rubber domes may provide biasing and switching functionality, but they may not be suitable for all applications. For example, rubber domes may not be suitable for keys with travel shorter than about 1.0 mm. Metal domes may be used for keys with travel shorter than about 0.5 mm, but traditional metal dome designs may be less reliable than is desired, and they may not be well suited for keys with travel above about 0.5 mm.

Described herein are key mechanisms, and domes for use in key mechanisms, that combine high reliability and durability with a desirable tactile response and stroke length. For example, a key mechanism may include a metal dome with arms extending from a central portion to form a cross shape. Some of the arms may act as spring or biasing arms that provide a biasing force to a keycap, but also allow the dome to deform or collapse under an actuation force. Other arms may act as upstop arms that interact with a travel limiting structure or feature of the key mechanism to limit upward travel of the keycap when the actuation force is removed (e.g., when the key is at rest or undepressed). Upstop arms may also be pressed against a lower surface of the keyboard when the key is depressed, causing the upstop arms to deflect and provide additional biasing or returning force on the keycap.

Figure 1:
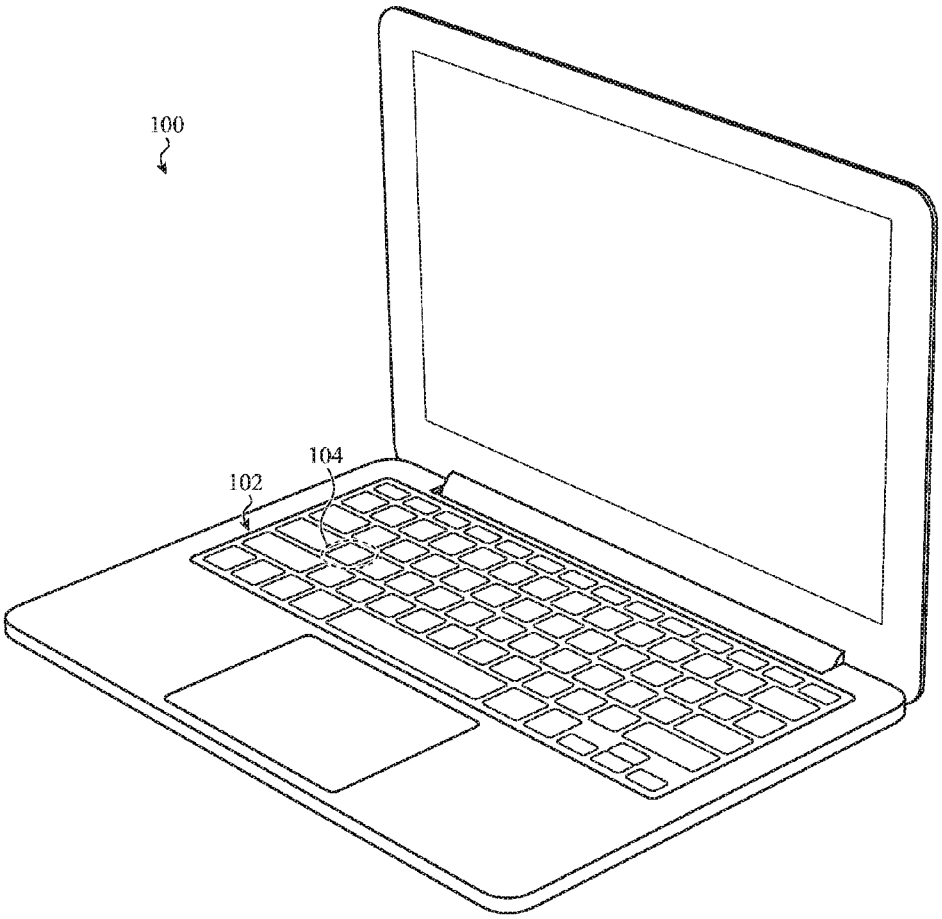
FIG. 1 shows an example computing device incorporating a keyboard.

FIG. 1 shows a computing device 100 having a keyboard 102 incorporated therein. As shown, the computing device 100 is a laptop computer, though it can be any suitable computing device, such as, for example, a desktop computer, a telephone, smart phone, or a gaming device. Moreover, while the keyboard 102 in FIG. 1 is incorporated with the computing device 100, the keyboard 102 may be separate from a computing device. For example, the keyboard 102 may be a standalone device that is connected (via a cable or wirelessly) to a separate computing device as a peripheral input device. The keyboard 102 includes a plurality of keys, including a representative key 104. While the instant application describes components of a representative key 104 of a keyboard 102, the concepts and components described herein apply to other depressible input mechanisms as well, such buttons, stand-alone keys, switches, or the like. Moreover, such keys, buttons, or switches may be incorporated into other devices, such as smart phones, tablet computers, or the like.

Figure 2:
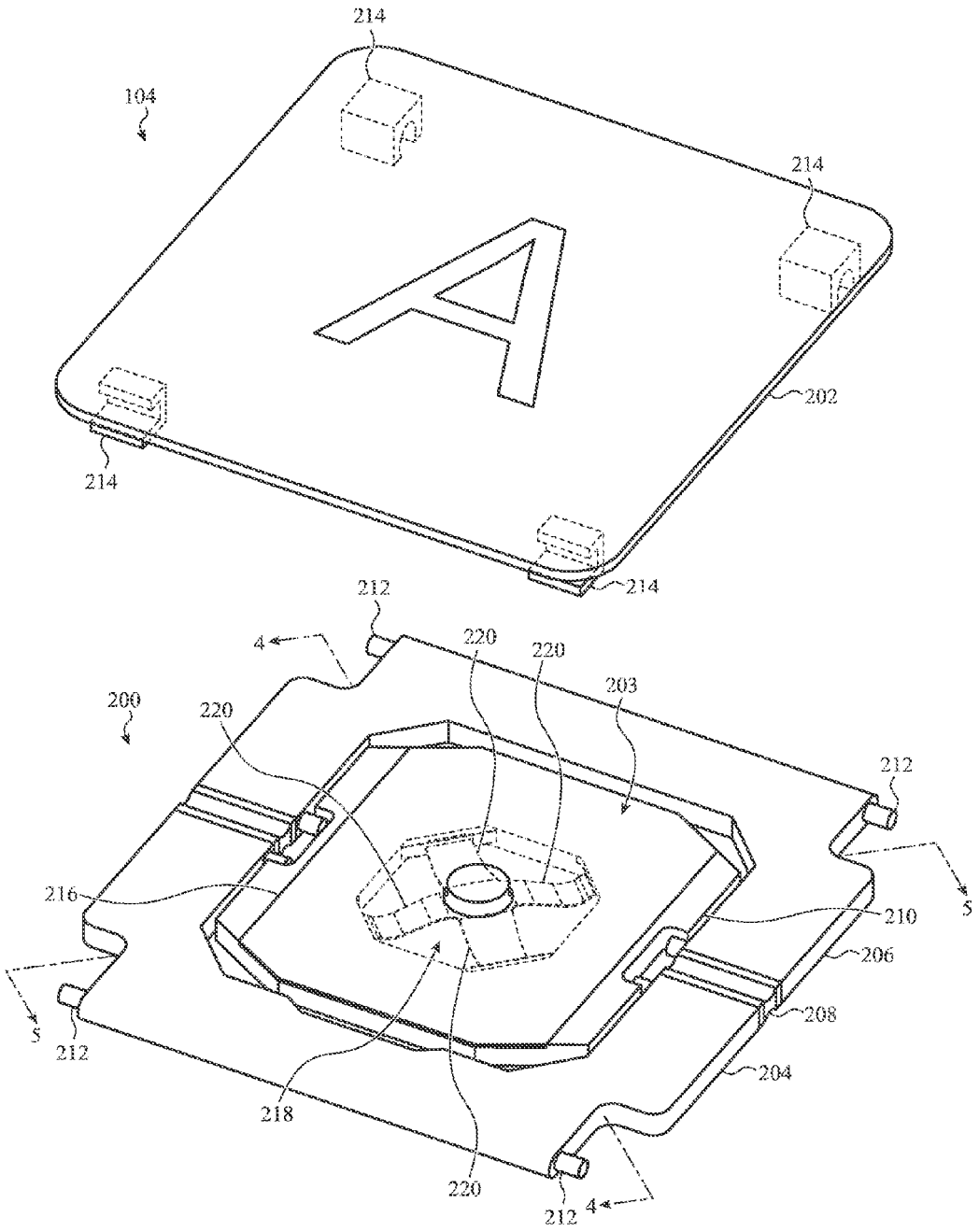
FIG. 2 shows an exploded view of a key.

FIG. 2 shows an exploded view of the key 104. The key 104 includes a keycap 202 coupled to an optional actuation mechanism 200 that allows the keycap 202 to move between a depressed and an undepressed position. The actuation mechanism 200 may include a first wing 204, a second wing 206, and a hinge 208 coupling the first wing 204 to the second wing 206. The hinge 208 may include any appropriate mechanism or material that attaches the first wing 204 to the second wing 206 while allowing the first wing 204 and the second wing 206 to articulate or move relative to each other. For example, the hinge 208 may include a gear hinge or a living hinge (e.g., a flexible material coupled to both the first and second wings 204, 206). Other mechanisms may be used instead of the actuation mechanism 200, such as scissor mechanisms or the like. In some cases, the actuation mechanism 200 may be omitted and the keycap 202 may be coupled to a switch member 218 that supports the keycap 202, biases the keycap 202 to an undepressed position, and provides switching functionality to the key 104. The switch member 218 may correspond to the dome 308 in FIG. 3.

The keycap 202 may be coupled to the first and second wings 204, 206 via pins 212 extending from the first and second wings 204, 206. The keycap 202 may include retention clips 214 extending from an underside of the keycap 202 that engage the pins 212. One pair of the retention clips 214 may allow its corresponding pins 212 to rotate therein, while the another pair may allow its corresponding pins 212 to rotate and slide therein. When the key 104 is actuated (e.g., pressed downward) the ends of the first and second wings 204, 206 where the pins 212 are located will move away from one another. By including at least a pair of retention clips 214 that allow the pins to slide relative to the keycap 202, the wings 204, 206 can articulate relative to one another without being mechanically bound by the retention clips 214. While FIG. 2 shows the pins 212 coupled to the wings 204, 206 and the retention clips 214 coupled to the keycap 202, the locations of the pins 212 and retention clips 214 may be swapped.

The key 104 also includes a switch assembly 203. The switch assembly 203 includes a dome support structure 210, the switch member 218 (e.g., corresponding to the dome 308, FIG. 3) coupled to the dome support structure 210, and a dome cover 216. The switch assembly 203 is configured to provide a biasing force and other switching functionality of the key 104. For example, arms 220 of the switch assembly 218 may bias the keycap 202 to an undepressed position, determine travel limits of the keycap 202 (both in an undepressed and a depressed position), and provide a particular force response to the key 104. The arms 220 may correspond to the first and second arms 312, 314 in FIG. 3.

The wings 204, 206 may be pivotally coupled to the switch assembly 203, and in particular, to the dome support structure 210. The dome support structure 210 may be fixed to a substrate (e.g., the substrate 318, FIG. 3), such as a keyboard base plate, a circuit board, a surface of an electronic device housing, or the like. Thus, the dome support structure 210 may serve as a mechanical link between a substrate, the wings 204, 206, and the keycap 202. In some cases, the wings 204, 206 may be pivotally coupled to a substrate of the keyboard instead of or in addition to being coupled to the switch assembly.

The dome cover 216 covers at least a portion of the dome support structure 210 and may act as a seal for the switch assembly 203, preventing or reducing the likelihood that dirt, moisture, or other contaminants will get inside the dome support structure 210. The dome cover 216 may be flexible such that an actuation force applied to the dome cover 216 from the keycap 202 will deform the dome cover 216 and be transmitted to components under the dome cover 216 (such as the dome 308, FIG. 3). The dome cover 216 may be any appropriate material, such as a flexible polymer (e.g., silicone) or fabric, and may be coupled to the dome support structure 210 in any appropriate way, such as with an adhesive.

Figure 3:
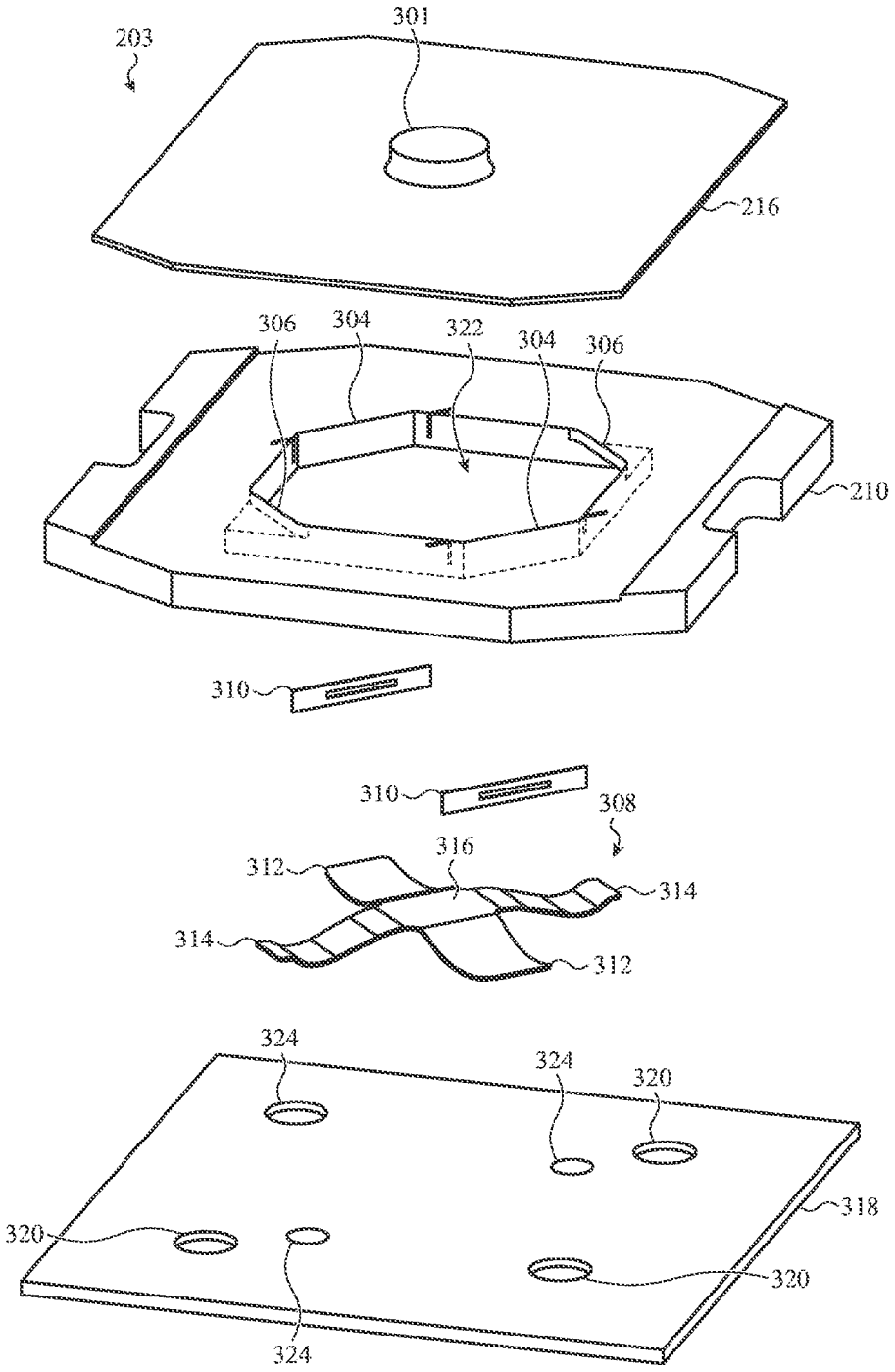
FIG. 3 shows an exploded view of a switch assembly.

FIG. 3 shows an exploded view of the switch assembly 203. The switch assembly 203 includes the dome support structure 210, a dome 308, the dome cover 216, and retention clips 310. As noted above, the switch assembly 203 may be coupled to a substrate 318, which may be a circuit board, base plate, housing, or the like, and which may include electrical contacts 324 that provide electrical switching functionality, as described herein.

The dome support structure 210 may be coupled to the substrate 318 in any appropriate way. For example, the dome support structure 210 may include pins, posts, clips, or other features extending downward and configured to be inserted into or otherwise engage with openings 320 of the substrate 318 to retain the dome support structure 210 to the substrate 318. Adhesives such as heat sensitive adhesives, pressure sensitive adhesives, or the like, may be used to secure the dome support structure 210 to the substrate 318. Adhesives may be used instead of or in addition to a mechanical engagement between the dome support structure 210 and the substrate 318 (such as the pins and openings described).

The dome support structure 210 defines an opening 322 in which a dome 308, or any other switch member, may be positioned. The retention clips 310 may be coupled to the dome support structure 210, and may include slots, cavities, channels, openings, recesses, or other features to receive a part of the dome 308 (e.g., an end of a spring arm 312, discussed below) and retain the dome 308 to the dome support structure 210. In some cases, instead of or in addition to the retention clips 310, the dome support structure 210 may include retention features on surfaces 304, such as slots, cavities, channels, openings, recesses, or other features that receive and retain part of the dome 308.

The dome support structure 210 further includes travel limiting features, such as upstops 306, that are configured to be contacted by upstop arms of the dome 308 to limit upward travel of the dome 308. For example, as shown in FIG. 3, the upstops 306 are undercuts that define a downward facing surface. Upstop arms 314 of the dome 308, discussed below, may extend under the upstops 306 such that when the dome 308 is biased in an upward or unactuated direction, the upstop arms contact the downward facing surface of the undercut and limit further upward travel of the dome 308. The upstops 306 need not be undercuts in all implementations, but may be any surface or feature that interacts with upstop arms to limit travel of the dome 308. For example, the upstops 306 may instead be slots, recesses, channels, or openings into which the upstop arms 314 extend.

The dome 308 provides a biasing force to the key 104 and may contribute to the tactile feel of the key 104 when the key 104 is actuated. In particular, the dome 308 is configured to deform or otherwise collapse when subjected to an actuation force, and is configured to return to an undeformed/uncollapsed state when the actuation force is removed. The resistance of the dome 308 to deformation or collapse, as well as the force caused by the dome returning to its undeformed or uncollapsed shape, is at least partly responsible for the particular tactile response of the key 104, as discussed herein.

The dome 308 includes first arms 312 and second arms 314 extending from an actuation region 316. The actuation region 316 is disposed relative to the keycap 202 such that, when the keycap 202 is actuated or depressed, an actuation force is transferred to the actuation region 316. For example, the dome cover 216 may include an actuation member 301, such as a post or protrusion integrally formed with or coupled to the dome cover 216, that transfers the actuation force from the keycap 202 to the actuation region 316 of the dome 308. More particularly, an underside of the keycap 202 may contact a top surface of the actuation member 301 and the bottom surface of the actuation member 301 may contact the actuation region 316 of the dome 308, thus transferring the actuation force from the keycap 202 to the dome 308.

The actuation region 316 may define a surface against which the actuation force (e.g., via the actuation member 301) is applied to the dome 308. The actuation region 316 may be substantially planar, convex, concave, or it may have any other appropriate shape or profile.

The first arms 312 and the second arms 314 may be cantilevered from the actuation region 316 and form a cross-shaped dome. In particular, each arm may have a first end and a second end, where the first end joins or is coupled to the actuation region 316 and the second end (the distal end) is free (e.g., it is not connected to the actuation region 316 or to the other arms except via its own arm). In the depicted example, and as described herein, the first arms 312 are spring arms and the second arms 314 are upstop arms.

The first arms 312, also referred to as spring arms 312, are configured to impart a biasing force that biases the dome 308 (and certain components coupled to or in contact with the dome 308, such as the keycap 202) in an undepressed or unactuated state. For example, as described herein, the spring arms 312 are configured such that an actuation force applied to the dome will cause the dome to deform and contact or otherwise actuate switching components of the key 104. When the dome 308 is deformed in response to an actuation force, the force produced by the spring arms 312 trying to return to their undeformed shape causes the dome 308 to return to the undepressed or unactuated state. The shape, material, and dimensions, of the spring arms 312, as well as the coupling between the spring arms 312 and the dome support structure 210, may influence or determine the amount of force required to collapse the dome 308, the length of travel of the dome 308, and other appropriate physical or operational parameters.

The dome 308 may be configured so that substantially all of the deformation of the dome 308 in response to an actuation force is due to deformation of the spring arms 312. For example, in contrast to domes where a central actuation portion changes shape when depressed (such as a convex dome that collapses into a concave or flat shape), the dome 308 may be configured so that the actuation region 316 remains substantially undeformed when subjected to typical actuation forces. In this way, the flexibility and deformation of the spring arms 312 are responsible for the actuation of the switch, rather than the flexibility and deformation of the actuation region 316. In some cases, the actuation region 316 may be configured to deform or collapse in response to an actuation force in addition to or instead of the spring arms 312.

The spring arms 312 couple the dome 308 to the dome support structure 210. For example, the distal ends of the spring arms 312 may be received in slots, cavities, channels, openings, recesses, or other features of the retention clips 310 (and/or the retention features on the surfaces 304), thereby coupling and retaining the dome 308 to the dome support structure 210. The retention clips 310 may be coupled to the dome support structure 210 in any appropriate way. For example, the retention clips 310 may be disposed in slots in the dome support structure 210, as shown in FIG. 3. Additionally or alternatively, they may be clipped, fastened (e.g., with a screw or other fastener), bonded, heat-staked, insert molded, or the like, to the dome support structure 210. In some cases, the retention clips 310 and the dome support structure 210 are formed from or comprise different materials. For example, the dome support structure 210 may be a polymer material, and the retention clips 310 may comprise a metal material (e.g., stainless steel).

The second arms 314, also referred to as upstop arms 314, are configured to interact with the dome support structure 210 (or another component) to limit upward travel of the dome 308 (e.g., travel in a direction that is opposite an actuation direction). For example, the upstop arms 314 may not be retained to the dome support structure 210, but instead may be free to move relative to the dome support structure 210 during actuation of the key 104. For example, the upstop arms 314 may contact the underside of the upstops 306 when the key 104 is in an undepressed or unactuated state, thereby limiting upward travel of the dome 308 beyond a certain amount. When the key 104 is in a depressed or actuated state, the up stop arms 314 may no longer be in contact with the upstops 306, and instead may be in contact with a substrate below the dome 308, as described herein.

While the dome 308 includes two spring arms 312 and two upstop arms 314, this is merely one example configuration, and different embodiments may have a different number of each type of arm. For example, a dome may include two spring arms 312 (or other biasing arms) and one upstop arm 314, or it may include four spring arms 312 and two upstop arms 314. As yet another example, a dome may include three spring arms 312 and two upstop arms 314. Other configurations, including any appropriate amount of each type of arm, are also possible.

The dome 308 may be formed from a metal material, such as a steel (e.g., stainless steel), aluminum, copper, gold, or tin. Other materials may also be used, such as composites (e.g., carbon fiber) or polymers. The dome 308 may be a unitary structure, such as a single, monolithic piece of metal that has been stamped or otherwise formed as a unitary component. Alternatively, the dome 308 may be formed from multiple parts assembled together. In such cases, the dome 308 may be formed from or comprise one material or multiple materials. For example, the first and second arms 312, 314 may be formed from or comprise one material (e.g., stainless steel), and the actuation region 316 may be formed from or comprise a different material (e.g., copper). The various parts may be coupled to one another to form the dome 308 in any appropriate way, including adhesives, mechanical fasteners, welds, solders, interlocking structures, or the like.

The configuration of the cantilevered first and second arms 312, 314 described herein may result in a dome 308 that is both durable and that has a desirable stroke length and tactile feel. In particular, the flexibility of the arms resulting from the arms 312, 314 being cantilevered from the actuation region 316 may reduce or eliminate stresses that may occur if the ends of the arms are coupled to one another or if the dome is formed from a hemispherical or other continuous dome. Further, the lower stresses experienced by the dome 308 allow the dome 308 to be designed with greater stroke length than would be possible or practical with other dome designs. For example, the dome 308 may have a stroke length of greater than 0.5 mm, greater than 0.75 mm, or greater than 1.0 mm. Shorter stroke lengths are also possible (e.g., 0.5 mm or less) and such domes may also benefit from increased durability and improved tactile response provided by the configuration of the dome 308.

The dome 308 is merely one example of a switch member that may be used in the key mechanisms described herein, and other switch members, including switch members of different shapes, sizes, and configurations may also be used. For example, an alternative switch member may have arms that are longer or shorter than the first and second arms 312, 314 of the dome 308. As another example, the actuation region of an alternative switch member may be larger relative to the lengths of its arms, or may have a different shape than the actuation region of the dome 308 (e.g., a circular shape rather than a square shape). Other variations and modifications are also contemplated.

Figure 4A:
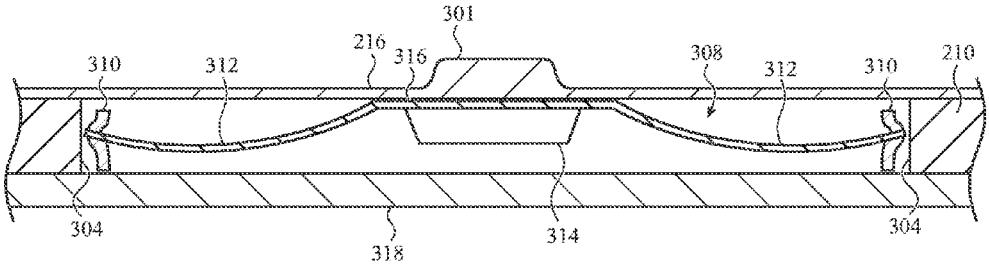
FIGS. 4A-4B show partial cross-sectional views of the key of FIG. 2.

FIG. 4A is a partial cross-section of the key 104 viewed along line 4-4 in FIG. 2, illustrating the key 104 in an unactuated or undepressed state. For clarity, some portions, components, or features of the key 104 are omitted from the view shown.

As shown in FIG. 4A, the distal ends of the spring arms 312 are received in openings in the retention clips 310 of the dome support structure 210, thereby retaining the dome 308 to the dome support structure 210. While not shown, the retention clips 310 may be omitted, and the distal ends of the spring arms 312 may be received into retention features (e.g., openings or recesses) on the surfaces 304 of the dome support structure 210. As yet another option, the distal ends of the spring arms 312 may pass through openings in the retention clips 310 and into openings or recesses in the surfaces 304.

In the unactuated state shown in FIG. 4A, the spring arms 312 may be strained or deformed. For example, the dome 308 and the dome support structure 210 may be configured such that the spring arms 312 are elastically deformed even when the key 104 is in the unactuated state. The spring arms 312 attempting to return to their unstrained states may produce a retention force that tends to keep the distal ends of the spring arms 312 securely engaged with the retention clips 310 (e.g., a radial force that presses the distal ends of the spring arms 312 into the retention clips 310). In some cases, the spring arms 312 may be unstrained (e.g., in a relaxed state) when the key 104 is not actuated.

The dome 308 may also include an optional deformable component (not shown) coupled to an underside of the actuation region 316. The deformable component may contact the substrate 318 and be compressed between the dome 308 and the substrate 318 when the key 104 is actuated. The deformable component may reduce a sound associated with the actuation, change a tactile response of the key 104 (e.g., so the key feels relatively soft to strike), increase the force required to actuate the key 104, adjust or set a travel distance of the key 104, increase a durability of the key 104, or the like. The optional deformable component may be formed from or include any appropriate material, such as silicone, a polyurethane foam, a spring (e.g., a coil spring or a flat spring), a gel, or any other appropriate material or component. The optional deformable component may instead be coupled to the substrate 318, such that a lower surface of the actuation region 316 contacts an upper surface of the deformable component when the key 104 is actuated.

Figure 4B:
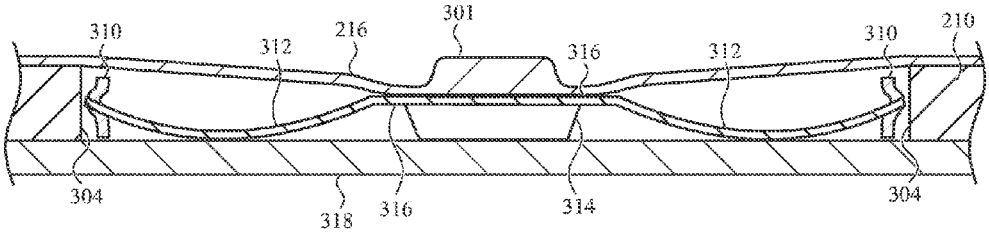

FIG. 4B is a partial cross-section of the key 104 viewed along line 4-4 in FIG. 2, illustrating the key 104 in an actuated or depressed state in which the dome 308 is deformed or collapsed. This position or state may occur in response to an actuation force being applied to the actuation region 316 via the actuation member 301. As shown, the spring arms 312 have deformed such that portions of the spring arms 312 have contacted the substrate 318. In embodiments where the key 104 includes the optional deformable component, it may be compressed between the dome 308 and the substrate 318. In some configurations, the dome 308 may be configured so that portions of the spring arms 312 and the actuation region 316 contact the substrate 318 when the key is actuated.

In some cases, the state of the key 104 depicted in FIG. 4B corresponds to a maximum travel of the key 104 (when subjected to operating forces within a typical range), and is also substantially coincident with or past a travel at which an actuation of the key 104 is registered (e.g., an input that will cause an electronic device to perform an action is detected). In other cases, the key 104 may be configured such that the spring arms 312 are not in contact with the substrate 318 when the maximum travel of the key 104 has been reached.

The spring arms 312 may be configured to buckle or otherwise change shape rapidly at a certain point during actuation of the key 104. For example, the concave portions of the spring arms 312 may be configured to rapidly change to a convex (or other) shape once the dome 308 has been subjected to a certain amount of force or travel. This action may provide a clicking effect when the key 104 is pressed, thus providing positive tactile feedback to a user that the key 104 has been actuated.

Figure 5A:
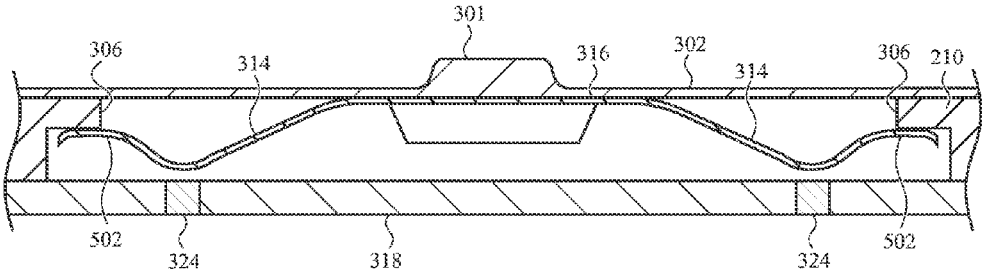
FIGS. 5A-5B show partial cross-sectional views of the key of FIG. 2.

FIG. 5A is a partial cross-section of the key 104 viewed along line 5-5 in FIG. 2, illustrating the key 104 in an unactuated or undepressed state. For clarity, some portions, components, or features of the key 104 are omitted from the view shown. Whereas FIG. 4A shows a cross-section through the spring arms 312 of the dome 308, FIG. 5A shows a cross-section through the upstop arms 314.

In the unactuated state in FIG. 5A, distal ends 502 of the upstop arms 314 are in contact with the upstops 306 of the dome support structure 210. In particular, the biasing force imparted to the dome 308 by the spring arms 312 may force the upstop arms 314 against the upstops 306 (or any other feature of the dome support structure 210 that is configured to contact and/or engage the upstop arms 314). Thus, while the spring arms 312 bias the dome 308 upwards, the upstop arms 314 limit the upward travel of the dome 308 in response to the biasing force. In this way, a maximum upward travel or position of the dome 308 when the dome 308 is not subjected to an actuation force can be established.

The spring arms 312 may be in a strained or deformed state when the key 104 is in the undepressed or unactuated position. For example, in embodiments where the spring arms 312 impart an upward biasing force on the dome 308 in the unactuated position, the biasing force may cause the distal ends 502 of the upstop arms 314 to deflect downward relative to the actuation region 316, thus producing a force that opposes the biasing force. Ultimately, the biasing force from the spring arms 312 and the opposing force from the up stop arms 314 reach equipoise, and the dome 308 reaches an equilibrium position corresponding to an upward travel limit of the dome 308.

In other cases, the upstop arms 314 may be in a substantially relaxed or unstrained state when the key 104 is in the undepressed or unactuated position. For example, the upstop arms 314 may be sufficiently stiff that they do not undergo substantial strain or deformation when they are in contact with the upstops 306. As another example, the dome 308 and/or the dome support structure 210 may be configured such that little or no force is being applied to the upstop arms 314 when the key 104 is in an unactuated position, resulting in the upstop arms 314 being substantially unstrained.

Figure 5B:
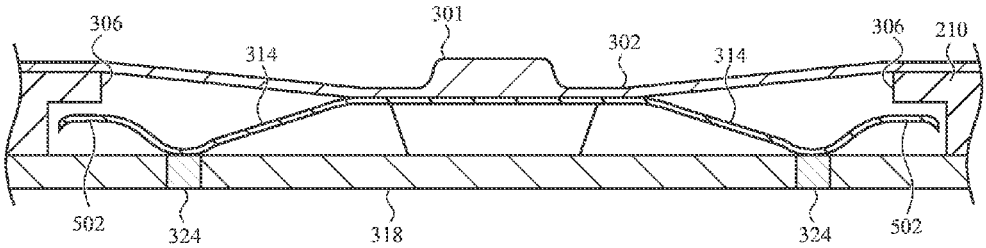

FIG. 5B is a partial cross-section of the key 104 viewed along line 5-5 in FIG. 2, illustrating the key 104 in an actuated or depressed position, such as may occur in response to an actuation force applied to the actuation region 316 via the actuation member 301. As shown, the dome 308 has been depressed to a position where the upstop arms 314 are in contact with the substrate 318. After the upstop arms 314 contact the substrate, they may deflect as the dome 308 is further depressed. The deflection of the upstop arms 314 due to contact with the substrate 318 may produce a counteracting force against further depression of the dome 308, which may provide a desirable tactile response to the key 104, such as a soft or compliant feeling as the key 104 is actuated.

The upstop arms 314 may be configured so that they contact the substrate 318 at a particular time relative to the operation of the spring arms 312 during a key actuation event. For example, the upstop arms 314 may be configured to contact the substrate 318 before, after, or at substantially the same time that the spring arms 312 contact the substrate 318. As another example, if the spring arms 312 are configured to buckle or otherwise change shape (e.g., to produce a clicking effect when the key is struck), the upstop arms 314 may be configured to contact the substrate 318 before, after, or at substantially the same time that the spring arms 312 buckle.

Figure 9:
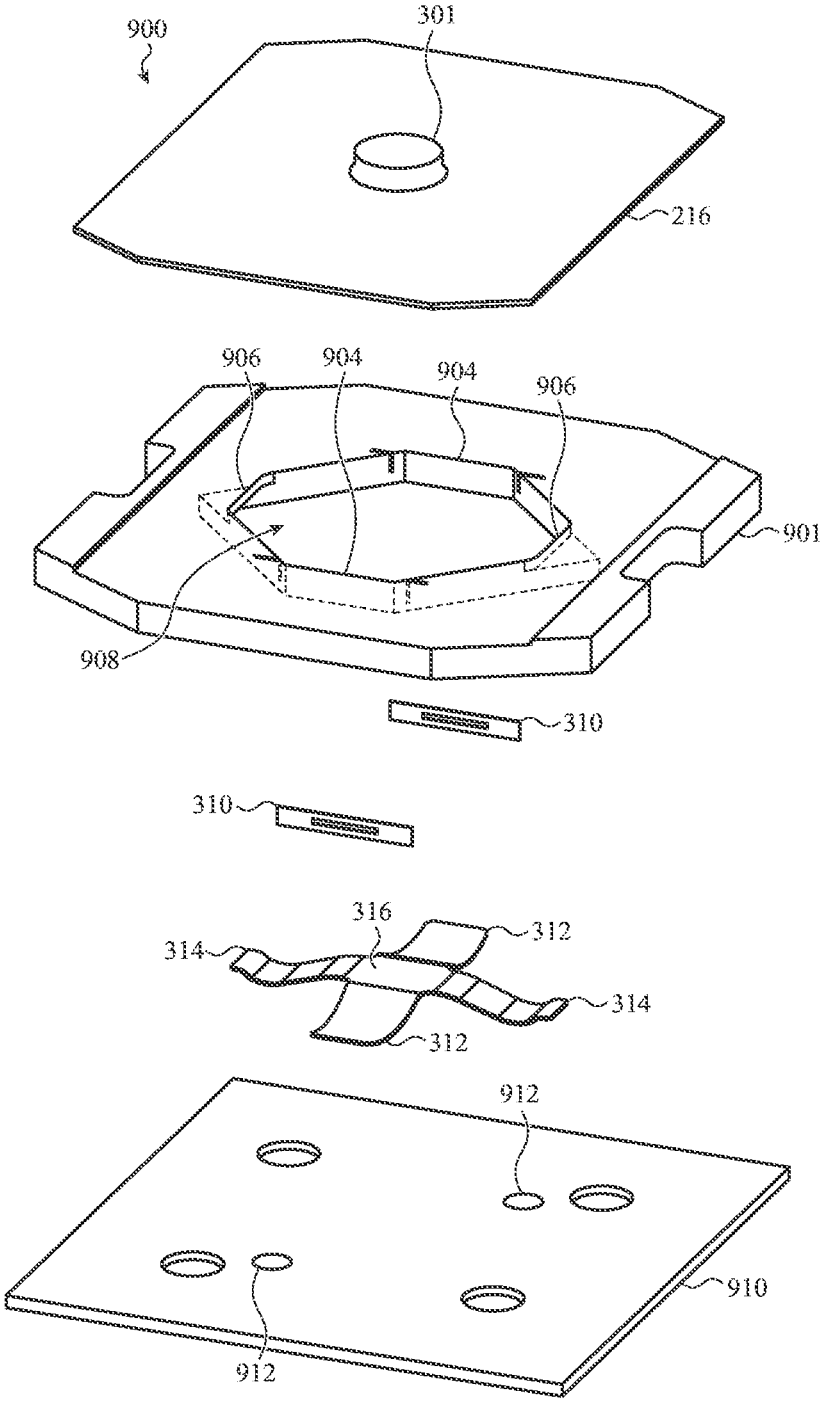
FIG. 9 shows an exploded view of another switch assembly.

As noted above, the substrate 318 may include electrical contacts 324. The upstop arms 314 may be configured to contact the electrical contacts 324 when the key 104 is actuated, thus providing a detectible switching event that may be used to indicate actuation of the key 104. For example, the upstop arms 314 (which may be formed from or comprise a conductive material such as metal) may complete a circuit between the electrical contacts 324, which may be detected by a processing system associated with the key 104 to register an actuation of the key 104. While the foregoing example positions the electrical contacts 324 below the upstop arms 314, electrical contacts 324 could also or instead be positioned below any portion of the dome 308 (e.g., the spring arms 312 or the actuation region 316). FIG. 9, for example, shows an embodiment where the electrical contacts are disposed below the spring arms 312.

In some cases, the upstop arms 314 are configured to contact the substrate 318, and thus contact the electrical contacts 324 and register an actuation of the key 104, at substantially the same time that the dome 308 clicks (e.g., due to a rapid change in shape of the dome 308). By configuring the key 104 so that these actions are substantially coincident, the clicking sensation experienced by a user when the key 104 is pressed may convey to the user that the key 104 has been actuated and that an input has been (or should have been) registered.

While the foregoing example uses the dome 308 to complete a circuit between the electrical contacts 324, actuation of the key 104 may be detected in other ways. For example, the key 104 may include, below the dome 308, a self-contained switching component that registers an actuation when compressed by the dome 308. As another example, the key 104 may include an optical switch (e.g., at least partially incorporated with the substrate 318) that detects a change in proximity of the dome 308 to the substrate 318. Other switching mechanisms may also be used.

Figure 6:
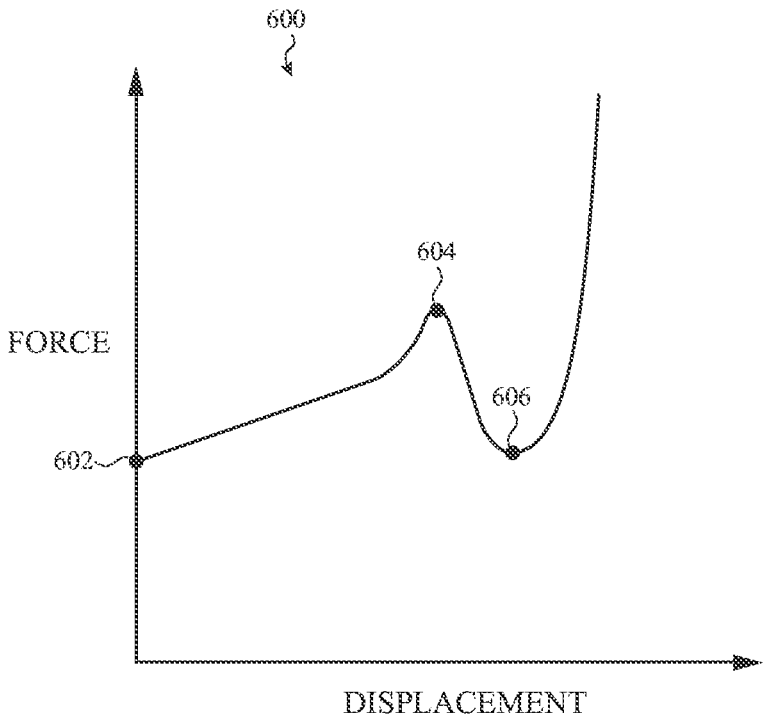
FIG. 6 shows a force versus travel curve of the key of FIG. 2.

FIG. 6 is a force versus travel curve 600 characterizing the force response of the key 104 using the dome 308. The curve 600 is merely exemplary, and the dome 308 may be tuned to exhibit different force responses by tuning, for example, the shapes, curvatures, materials, or dimensions of the dome 308.

With respect to the curve 600, as an actuation force causes the keycap 202 to move and the dome 308 begins to deform, the force response of the key 104 increases from point 602 until a pressure point 604 is reached. The pressure point 604 may correspond to a point at which a rapid deformation of the dome 308 begins (e.g., corresponding to a click that may be felt and/or heard by a user).

After the pressure point 604, the responsive force of the dome 308 decreases until it reaches the operating point 606, which may correspond to any combination of the spring arms 312, the upstop arms 314, or the actuation region 316 contacting the substrate 318. Under normal operating conditions and forces, the operating point 606 may be at or near a maximum travel of the key 104, and thus may correspond to a point at which the dome is fully or substantially fully collapsed.

The key 104 may be configured such that the dome 308 contacts the electrical contacts 324 at any appropriate point along the force versus travel curve 600. For example, the dome 308 my contact the electrical contacts 324 at or near the pressure point 604. As another example, the dome 308 my contact the electrical contacts 324 at or near the operation point 606. As yet another example, the dome 308 my contact the electrical contacts 324 between the pressure point 604 and the operation point 606.

Figure 7:
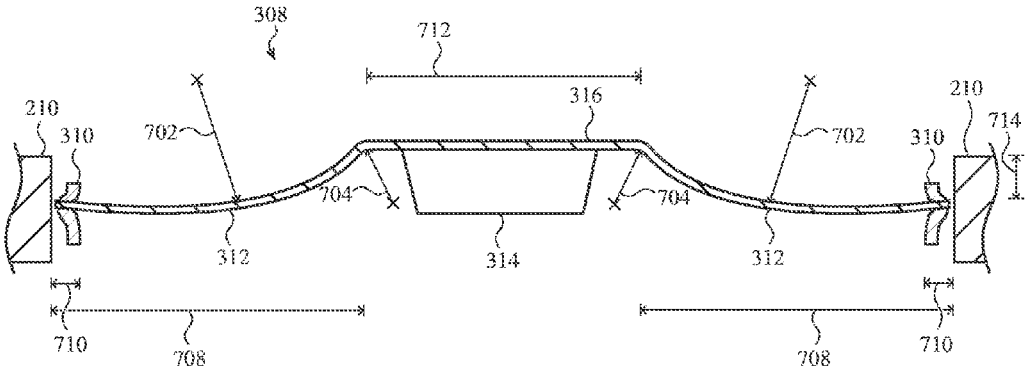
FIG. 7 shows a partial cross-sectional view of the key of FIG. 2.

Certain physical characteristics of the dome 308, such as the material, dimensions, shape, and the like, may determine the particular force versus travel curve exhibited by the key 104. FIG. 7 is a partial cross-section of the key 104 viewed along line 4-4 in FIG. 2, illustrating dimensions that define certain aspects of the dome 308 and that may be adjusted or tuned during a design phase to achieve a desired tactile response. Such dimensions include, for example, a length 712 of the actuation region 316, a length 708 of the spring arms 312, a distance 710 that the spring arms 312 extend past the retention clips 310 and/or the retention features on the surfaces 304, and a height 714 from the bottom of the spring arms 312 to the top of the actuation region 316.

The physical dimensions and characteristics of the curved portions of the dome 308 may contribute to the tactile response of the key 104. For example, the dome 308 has a first curved portion (e.g., where the spring arms 312 join the actuation region 316). The first curved portion, which is convex as shown in FIG. 7, may be characterized by a radius 704. Beyond the first curved portion, the spring arms 312 have a second curved portion (concave in FIG. 7) characterized by a radius 702. The radius 702 may be greater than the radius 704, such as at least two times greater than the radius 704. Each of the first and second curved portions may also be characterized by an eccentricity or other parameter indicating a deviation from a circular or spherical curve.

While FIG. 7 illustrates a symmetrical dome 308 (e.g., where both spring arms 312 have substantially the same dimensions), this need not be the case. For example, the spring arms 312 may have different dimensions, such as different radii, different lengths, different thicknesses, and different end constraints (e.g., an end of one spring arm 312 may be fixed to its respective retention clip 310, while an end of another spring arm 312 may be configured to slide within the retention clip 310).

While the actuation region 316 and the spring arms 312 both have uniform thicknesses in FIG. 7, this need not be the case. For example, the spring arms 312 may have a different thickness (e.g., a smaller or larger thickness) than the actuation region 316. As another example, the spring arms 312 may have different thicknesses at different locations along the arms. By configuring the dome 308 with different thicknesses, the flexibility and/or durability of the dome 308 in certain areas may be optimized or tuned. For example, the first curved portion of the dome 308 may have a thickness that is greater than adjacent portions of the spring arms 312 and the actuation region 316. This may result in a stiffer dome than one where the first curved portion is thinner or the same thickness as surrounding areas. Similarly, the first curved portion of the dome 308 may be thinner than adjacent areas of the dome 308, thus allowing the dome to be actuated with a lower actuation force. In yet other configurations, the second curved portion of the dome 308 may have a thickness that is larger or smaller than other portions of the dome 308.

Figure 8:
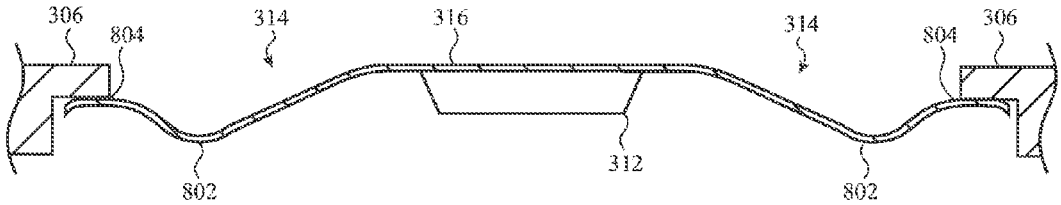
FIG. 8 shows a partial cross-sectional view of the key of FIG. 2.

FIG. 8 is a partial cross-section of the key 104 viewed along line 5-5 in FIG. 2, illustrating a shape of the upstop arms 314. The upstop arms 314 may each have a first curved portion 802 and a second curved portion 804. The first curved portion 802 may be configured to contact the substrate 318, and optionally the electrical contacts 324. The second curved portion 804 may be configured to contact the upstops 306 of the dome support structure 210. The curved portions 802, 804 may provide smooth surfaces to contact both the substrate 318 and the upstops 306, respectively. For example, a sharp corner or edge at the end of the upstop arm 314 may scratch or score the upstops 306. The curved portion 804, on the other hand, provides a smooth, continuous surface that can slide along the upstops 306 without undue friction, scratching, or scoring that may cause damage to the upstop arms 314, the upstops 306, or both.

Similar to the discussion above with respect to FIG. 7, the upstop arms 314 and the actuation region 316 need not have a uniform thickness. For example, the upstop arms 314 may have different thicknesses at different locations along the arms. As another example, the upstop arms 314 may a different thickness (e.g., a smaller or a larger thickness) than the actuation region 316.

FIG. 9 shows an exploded view of a switch assembly 900. The switch assembly 900 is similar to the switch assembly 203 described with respect to FIG. 3, but illustrates an embodiment where the dome 308 is rotated 45 degrees from the position shown in FIG. 3. To accommodate this change, the switch assembly 900 includes a dome support structure 901 with a different configuration than the dome support structure 210. In particular, the opening 908 of the dome support structure 901 is rotated 45 degrees relative to the position of the opening 322 in the dome support structure 210 (FIG. 3). This rotation moves the positions of the upstops 906 (and optional dome retention features on surfaces 904) to correspond to positions of the upstop arms 314 and the spring arms 312 in the switch assembly 900.

Additionally, the substrate 910 in FIG. 9 includes electrical contacts 912 positioned under the spring arms 312 rather than the upstop arms 314, as shown in FIG. 3. This illustrates an alternative positioning of the electrical contacts 912 relative to the dome 308, and is not limiting. For example, the electrical contacts 912 (or any other switching contacts or mechanisms that may be used instead of or in addition to the electrical contacts 912) may be positioned under the upstop arms 314, under the actuation region 316, or at any other appropriate location.

Figure 10:
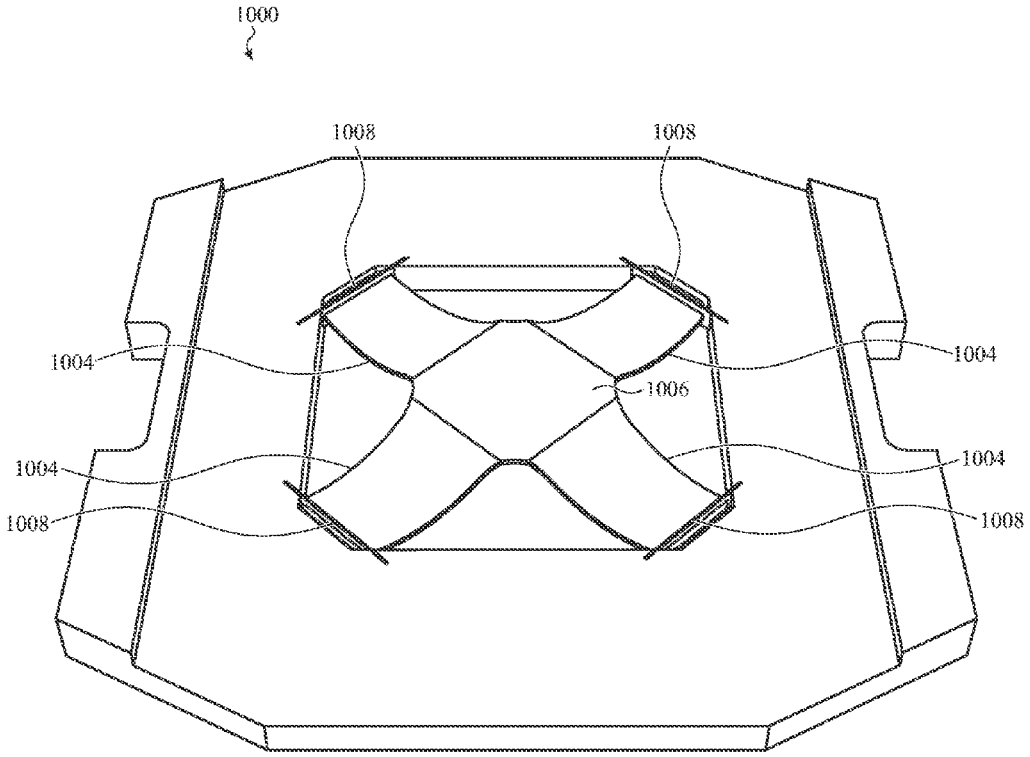
FIG. 10 shows a portion of yet another switch assembly.

FIG. 10 shows a portion of a switch assembly in which a dome 1000 includes four spring arms 1004 that are each coupled to a dome support structure 1002. The dome support structure 1002 and dome 1000 may be substituted for the dome support structure 210 and the dome 308 in the key 104.

Each of the spring arms 1004 extend from an actuation region 1006, similar to the configuration of the spring arms 312 of the dome 308. The spring arms 1004 and the actuation region 1006 may incorporate any of the shapes, materials, and configurations of the spring arms 312 and actuation region 316 described above with respect to the dome 308. Each spring arm 1004 is coupled to the dome support structure 1002 via a retention clip 1008, and/or an optional retention feature (not shown) of the dome support structure 1002.

The dome 1000 may be configured so that substantially all of the deformation of the dome 1000 in response to an actuation force is due to deformation of the spring arms 1004. For example, in contrast to domes where a central actuation portion changes shape when depressed (such as a convex dome that collapses into a concave or flat shape), the dome 1000 may be configured so that the actuation region 1006 remains substantially undeformed when subjected to typical actuation forces. In this way, the flexibility of the spring arms 1004 is responsible for the actuation of the switch. In some cases, the actuation region 1006 may be configured to deform or collapse in response to an actuation force in addition to or instead of the spring arms 1004.

Figure 11:
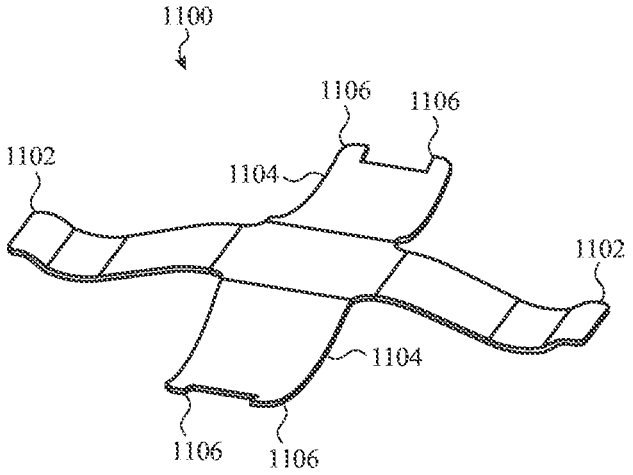
FIG. 11 shows an example dome for use in the key of FIG. 2.

FIG. 11 shows a dome 1100 that may be used with the key 104. Like the dome 308, the dome 1100 includes spring arms 1104 and upstop arms 1102. However, each spring arm 1104 of the dome 1100 includes two tabs 1106 at its distal end. When used in the key 104, the tabs 1106 may be the only portions of the spring arms 1104 that are inserted in the openings or recesses of the retention clips or the retention features of the key 104.

Figure 12:
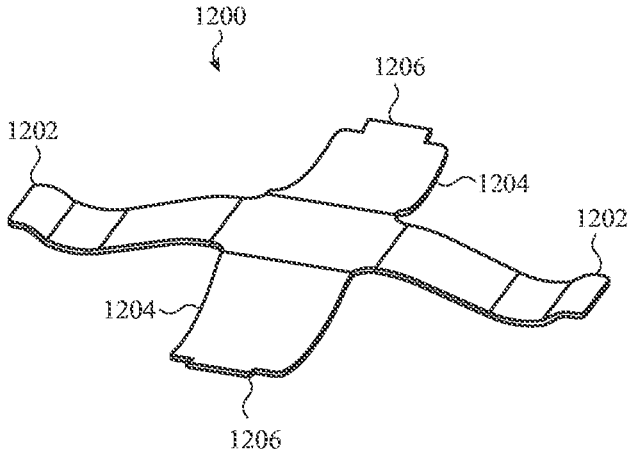
FIG. 12 shows another example dome for use in the key of FIG. 2.

FIG. 12 shows a dome 1200 that may be used with the key 104. Like the dome 308, the dome 1200 includes spring arms 1204 and upstop arms 1202. However, each spring arm 1204 of the dome 1200 includes a tab 1206 at its distal end. When used in the key 104, the tabs 1206 may be the only portion of the spring arms 1204 that are inserted in the openings or recesses of the retention clips or the retention features of the key 104.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings. Also, when used herein to refer to positions of components, the terms above and below, or their synonyms, do not necessarily refer to an absolute position relative to an external reference, but instead refer to the relative position of components with reference to the figures. Similarly, the terms convex (e.g., curved downward) and concave (e.g., curved upward) should be understood as referring to shapes of components viewed according to the orientations in the associated figures.

What is claimed is:

1. A key mechanism, comprising:

a keycap; a dome support structure positioned relative to the keycap and defining:

an opening; and a travel limiting feature;

an actuation mechanism coupled to the keycap and configured to movably support the keycap relative to the dome support structure; and a unitary metal dome positioned in the opening of the dome support structure and comprising an upstop member; wherein the keycap is movable between an undepressed position and a depressed position; and in the undepressed position, the upstop member contacts the travel limiting feature of the dome support structure, thereby limiting upward travel of the unitary metal dome.

2. The key mechanism of claim 1, wherein: the key mechanism further comprises an electrical contact below the unitary metal dome; and in the depressed position, the electrical contact is actuated by the unitary metal dome.

3. The key mechanism of claim 2, wherein: in the depressed position, the upstop member is in contact with the electrical contact; and in the undepressed position, the upstop member is not in contact with the electrical contact.

4. The key mechanism of claim 2, wherein: the key mechanism further comprises a substrate below the unitary metal dome; and in the depressed position, the upstop member contacts the substrate such that the upstop member deflects.

5. The key mechanism of claim 4, wherein: the key mechanism is moved to the depressed position in response to an actuation force on the keycap; and when deflected, the upstop member imparts on the keycap a returning force that opposes the actuation force.

6. The key mechanism of claim 4, wherein: the unitary metal dome further comprises a spring arm; and during actuation of the key mechanism, both the spring arm and the upstop member contact the substrate to impart on the keycap a returning force that opposes an actuation force on the keycap.

7. The key mechanism of claim 2, wherein: the unitary metal dome further comprises a spring arm coupled to the dome support structure; in the undepressed position: the spring arm biases the unitary metal dome upwards; and the upstop member opposes the upwards bias of the spring arm.

8. A key mechanism, comprising:

a keycap;

a dome support structure defining a travel limiting feature; and a unitary metal dome coupled to the dome support structure and comprising: an actuation region; a first arm extending from the actuation region, and a second arm extending from the actuation region, wherein when the key mechanism is in an undepressed state, the first arm contacts the travel limiting feature of the dome support structure; and the second arm defines a first end that is coupled to the dome support structure to retain the unitary metal dome to the dome support structure.

9. The key mechanism of claim 8, wherein when the key mechanism is in a depressed state, the first arm is not in contact with the travel limiting feature.

10. The key mechanism of claim 8, wherein the first arm comprises: a first curved portion configured to contact the travel limiting feature; and a second curved portion configured to contact a substrate below the unitary metal dome when the key mechanism is in a depressed state.

11. The key mechanism of claim 8, wherein: the unitary metal dome further comprises; a third arm extending from the actuation region and comprising a second end that is attached to the dome support structure to retain the unitary metal dome to the support structure.

12. The key mechanism of claim 11, wherein: the travel limiting feature is a first travel limiting feature; the dome support structure defines a second travel limiting feature; and the unitary metal dome further comprises a fourth arm extending from the actuation region, wherein when the key mechanism is in the undepressed state, the fourth arm contacts the second feature of the dome support structure.

13. The key mechanism of claim 11, further comprising first and second clips coupled to the dome support structure and configured to receive the first and second ends, respectively, of the first and second arms.

14. A dome for an input mechanism, comprising: an actuation region; first and second cantilevered biasing arms extending from the actuation region; each having a first shape defined at least in part by a first curvature; and first and second cantilevered upstop arms extending from the actuation region, each having a second shape defined at least in part by a second curvature that is different than the first curvature.

15. The dome of claim 14, wherein the first and second cantilevered biasing arms each comprise: a first portion adjacent the actuation region and having a convex shape; and a second portion adjacent the first portion and having a concave shape.

16. The dome of claim 15, wherein: the convex shape has a first radius; and the concave shape has a second radius greater than the first radius.

17. The dome of claim 14, wherein: the first and second cantilevered biasing arms extend from first opposing sides of the actuation region; and the first and second cantilevered upstop arms extend from second opposing sides of the actuation region.

18. The dome of claim 14, wherein distal ends of the first and second cantilevered biasing arms and the first and second cantilevered upstop arms are not coupled to one another.

19. The key mechanism of claim 1, further comprising a deformable cover attached to the dome support structure over the unitary metal dome and configured to deform when the unitary metal dome is collapsed by the actuation mechanism.

20. The dome of claim 14, wherein:

the first cantilevered biasing arm defines a first tab at a distal end of the first cantilevered biasing arm;

the second cantilevered biasing arm defines a second tab at a distal end of the second cantilevered biasing arm; and the first and second tabs are configured to engage a dome support structure to retain the dome to the dome support structure.

* * * * *